United States Patent [19]

Everard

[11] Patent Number: 4,508,126

[45] Date of Patent: Apr. 2, 1985

[54] RETRACTABLE AWNING FOR MOBILE DWELLINGS

[75] Inventor: Lloyd D. Everard, Kent, Wash.

[73] Assignee: Valley Industries, Inc., Lodi, Calif.

[21] Appl. No.: 384,010

[22] Filed: Jun. 1, 1982

[51] Int. Cl.[3] ..... E04F 10/06

[52] U.S. Cl. ..... 135/89; 135/114; 160/67

[58] Field of Search ..... 135/88, 89, 107, 903, 135/109, 25 R, 42, 74, 110–112, 106, 65, 102, DIG. 9, 114, 117; 160/66–70, 383; 273/80 B; 403/92, 93, 96, 101, 102, 85; 248/240, 166, 240.4, 293, 528, 357, 200.1; 108/80–82; 5/111, 114, 130; 272/62, 63

[56] References Cited

U.S. PATENT DOCUMENTS

| | | | |
|---|---|---|---|
| 1,029,609 | 6/1912 | Hammond | 5/130 |
| 1,714,698 | 5/1929 | Stoll | 135/114 |
| 1,793,035 | 2/1931 | Whitney | 248/354 |
| 3,426,367 | 2/1969 | Bradford | 5/114 |
| 3,461,593 | 8/1969 | Martuch et al. | 273/80 B |
| 3,612,145 | 10/1971 | Darula | 135/106 X |
| 3,789,903 | 2/1974 | Clark et al. | 135/89 X |
| 3,918,510 | 11/1975 | Hayward | 135/89 X |
| 3,923,074 | 12/1975 | McKee | 135/89 |
| 4,198,998 | 4/1980 | Duffy | 135/89 |
| 4,253,689 | 3/1981 | McKee | 160/67 |
| 4,258,778 | 3/1981 | Upton et al. | 160/67 |

FOREIGN PATENT DOCUMENTS

| | | | |
|---|---|---|---|
| 2027369 | 2/1971 | Fed. Rep. of Germany | 160/68 |

*Primary Examiner*—Richard J. Apley
*Assistant Examiner*—S. R. Crow
*Attorney, Agent, or Firm*—Townsend and Townsend

[57] ABSTRACT

An improved retractable awning for mobile dwellings and for other installation places, has an interior, partial length, centered, stiffener inserted into an awning roller tube to substantially eliminate any unreasonable sag across a long span of an awning, and also has simplified rafter bars, each with a more convenient automatic latch, which is easily released by pushing a button.

2 Claims, 6 Drawing Figures

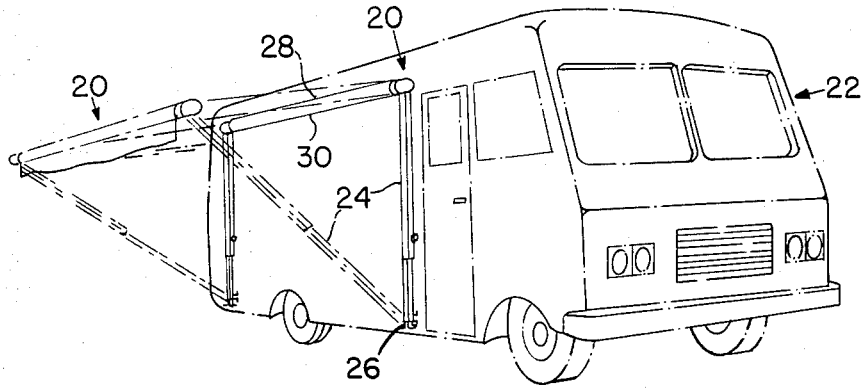
FIG. 1
FIG. 2
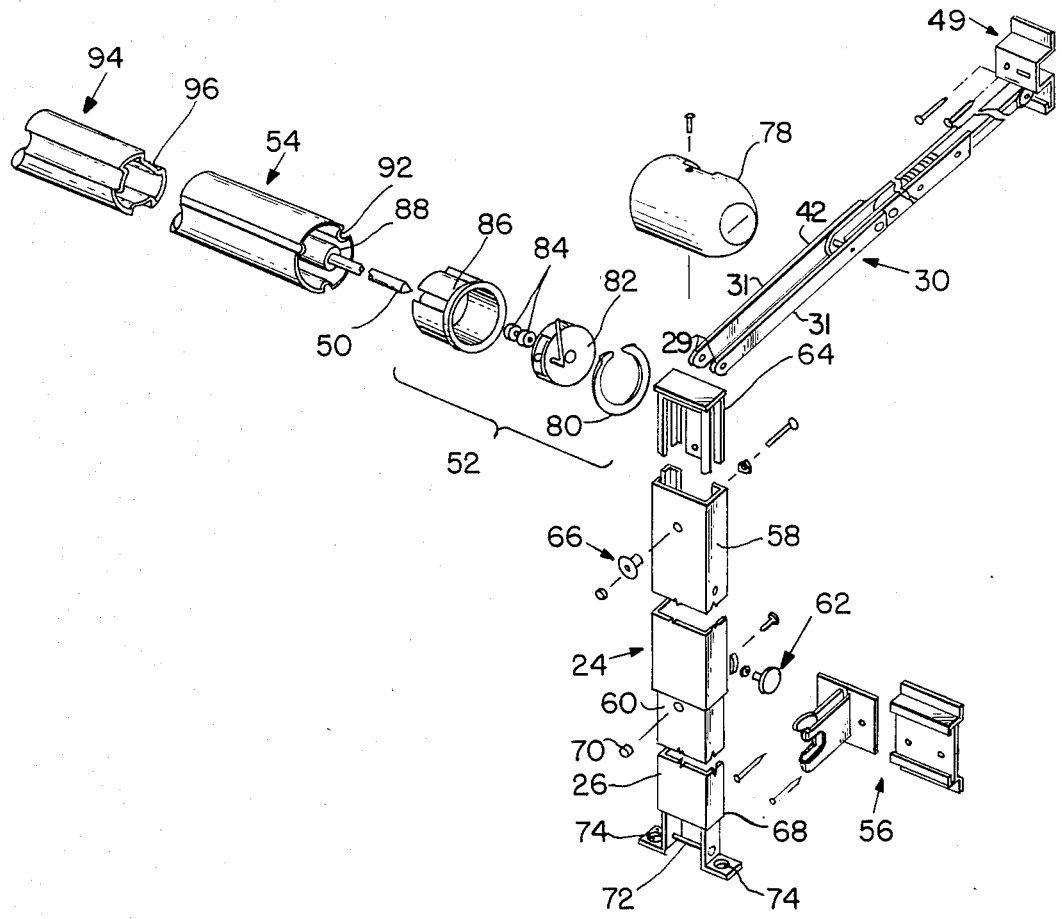

FIG. 3
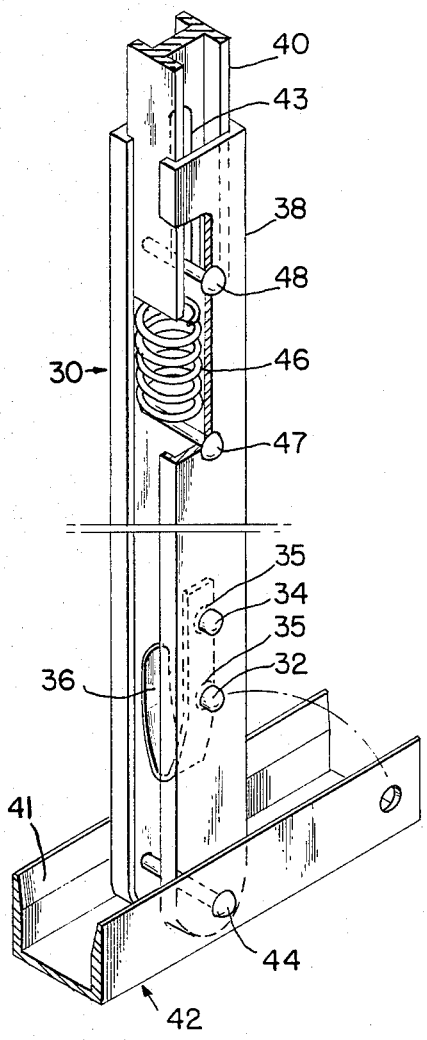
FIG. 5
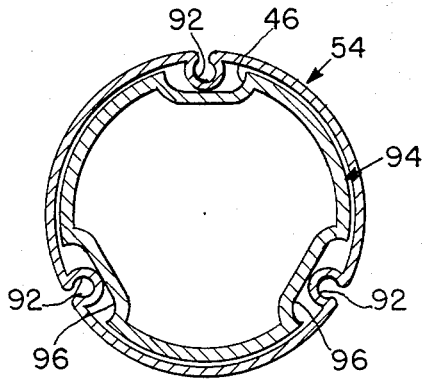
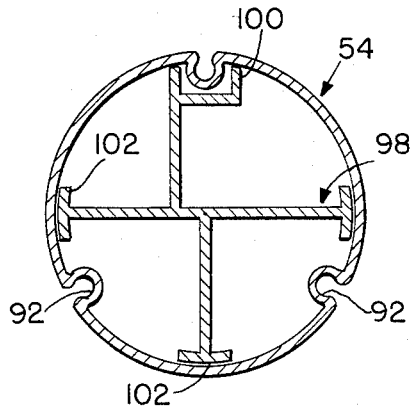
FIG. 6
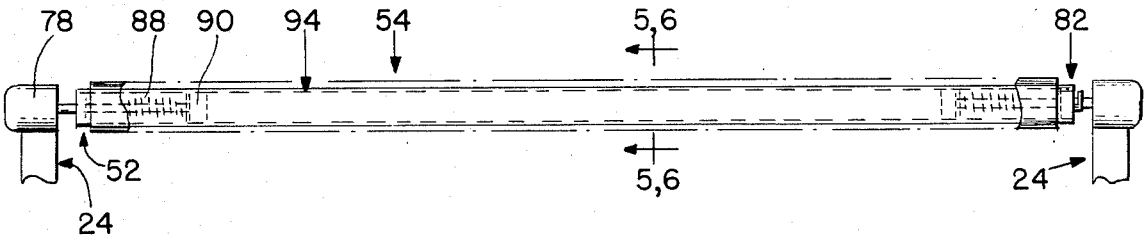
FIG. 4

RETRACTABLE AWNING FOR MOBILE DWELLINGS

BACKGROUND OF INVENTION

Retractable awnings for mobile dwellings have been used for several years. Currently, however, when such awnings are of long span, the roller tube sags between its end supports. Therefore, with the awning pulled out from around the roller tube and extended away from the side of a mobile dwelling, the awning also sags, reflecting the initial sag of the roller tube, throughout the central portions of the extended awning.

Moreover, in the past there have been some retractable awnings which seem to involve too many component parts and/or which also seem to involve latches and other adjustable mechanisms which are not too conveniently manipulated.

SUMMARY OF THE INVENTION

Retractable awnings for mobile dwellings are improved by the convenient endwise slide-in insertion into the awning roller tube of an interior, partial length, centered, stiffener, having a complementary cross section, which avoids any binding or inteference during insertion with the interior structure of the roller tube. With the stiffener centered in place when the awning is then unrolled and extended, there is no noticeable sag in the awning. The roller tube with its centered stiffener continues to maintain its straight or near straight appearance, so no substantial reflective sag is created in the fabric of the awning.

Also in regard to extending and retracting these awnings, the overall subassembly of each rafter bar has been simplified and equipped with a more convenient automatic latch, which is easily released by pushing a very accessible button.

DESCRIPTION OF THE DRAWINGS

An improved retractable awning for mobile dwellings, such as for use with a motor home is illustrated in the drawings, wherein:

FIG. 1, is a perspective view of a motor home with this installed improved retractable awning, the solid lines indicating the retracted position and the dotted lines indicating the extended position, when the uprights are still supported on the side of the motor home, rather than being vertically positioned in the optional patio arrangement;

FIG. 2, is an exploded perspective view of one corner arrangement of the metal components, and other metal components, which, with others not shown in this view, are used to secure the awning to the side of a mobile dwelling or elsewhere, and thereafter conveniently and safely, extend and retract the completed awning assembly;

FIG. 3 is an enlarged partial section of one rafter bar to illustrate some of the improvements directed to utilization of fewer components and providing a more convenient and simpler latch assembly;

FIG. 4 is a partial view, with portions broken away, to illustrate the centered position of the interior partial length stiffener installed in the roller tube of the awning;

FIG. 5 is an enlarged cross sectional view of a preferred embodiment of the interior, partial length, centered stiffener, in its installed position within the interior of the roller tube of the awning; and FIG. 6, is an enlarged cross sectional view of another embodiment of the interior, partial length, centered stiffener, in its installed position within the interior of the roller tube of the awning.

DESCRIPTION OF THE INVENTION

General Conventional Configuration of the Awning in Respective Positions

In FIGS. 1 through 5, an overall preferred embodiment is illustrated of an improved retractable awning assembly 20 for mobile dwellings which is also useful for other installations. In FIG. 1, a motor home 22 is shown equipped with a retractable awning assembly 20. The solid lines used in FIG. 1, indicate the retracted position, and the dotted lines indicate one of the extended positions, wherein the designated upright supports 24 are secured to the motor home 22 at their lower ends 26. In the other extended position, which is not shown, the upright supports 24 become vertically positioned while resting on the ground, boards, bricks, gravel, and/or pavement.

Improved Rafter Bars

The overall essential metallic components which hold and control the awning 28, per se, are indicated in FIG. 2 in a perspective exploded view of one corner arrangement. The awning 28, per se, is not illustrated in FIG. 2. The upright supports 24 are essentially conventional. The rafter bars 30, however, are improved. Fewer components are used in the subassemblies of these rafter bars 30, and their locking and release is undertaken in an improved way by using a locking button 32 and a spaced adjacent release button 34, which are both spring biased and positioned by the same bar spring 36, and move through holes 35 to be observed at all times to insure their proper functioning.

The improved rafter bars 30, illustrated in FIGS. 2 and 3, comprise a box channel 38, an I beam 40, and an inside partially inserted U shaped channel 42, with the pivotal interconnection pin 44 between the box channel 38 and the U shaped channel 42. A compression spring 46 is mounted within the U shaped channel 42 and abuts against the I beam 40. Pin 47 secures and positions the spring 46, and pin 48 secures and positions the I beam 40 with respect to the box channel 38, and slot 43 in I beam 40.

One end of the improved rafter bar 30 is removably secured to the side of the motor home 22 by the slide end securement assembly 49. The other end of the rafter bar 30 is connected to a shaft 50 of a roller tube end sub assembly 52, using spaced holes located respectively in the upstanding flanges 31 of the U-shaped channel 42 so the center of rotation of rafter bar 30 is on the centerline of the roller tube 54. By having this rotation of the rafter bar 30 about the centerline of the roller tube 54 there is no tendency to create a stretching force in the awning 28, when the upright supports 24 are rotated with respect to the rafter bars 30 in changing the support positions of the lower ends of the upright supports 24 from the ground to the side of the motor home 22, where the latch slide in assembly 56 is secured to the motor home 22.

Conventional Upright Support

In reference to these two alternately selected support positions, generally the upright supports 24 are telescopically lengthened in the ground support position.

The telescoping sections 58, 60, are secured in selected extended positions by the securement assembly 62. The top telescoping section 58 has an insertable top housing 64 to receive the shaft 50 of the roller tube end subassembly 52 and also the end of the rafter bar 30. Fastener assembly 66 secures the top housing 64 to the top telescoping section 58 of the upright support 24. At the bottom of the bottom telescoping section 60 a combination support subassembly 68 is inserted and held by fastener 70. It provides a pin 72 for removable securement to the latch slide-in assembly 56, when the upright support 24 is held against the motor home 22, and also this combination support subassembly 68 provides spaced recessed structures 74, i.e. holes, to receive respective ground stakes 76 when they are used to position the upright supports 24 in their vertical support positions. When the roller tube end subassembly 52, the rafter bar 30, and the upright supports 24 are finally assembled, they are collectively encompassed by the end cover 78.

During the locking button 32 and release button 34 spring action, a tapered inner top edge 41 of the U shaped channel 42 serves to provide an excellent entry camming function.

Conventional Roller Tube for Awning

Conventional roller tubes for awnings, as illustrated in FIG. 1, are widely used. The way in which the awnings are attached to the roller tubes is illustrated in U.S. Pat. No. 3,918,510 of 1975 as shown in FIG. 11 of this 1975 patent, and also as illustrated in FIG. 2 of U.S. Pat. No. 4,258,778 of 1981, and moreover as illustrated in FIG. 2 of U.S. Pat. No. 3,612,145 of 1971. Also in FIG. 8 of this U.S. Pat. No. 3,612,145 the conventional way the awning is attached to the side of a motor home or other dwelling is illustrated. At both the side of a motor home and at a roller tube, as especially shown in U.S. Pat. No. 3,612,145, the awning fabric is sewn to form a lengthwise pocket or hem to receive and enclose a nylon rope or cord. This resulting enlarged end of the awning is then slidably entered lengthwise into the roller tube using a substantially circular groove having a restricted slot communicating with the groove to accommodate the awning fabric, per se.

As illustrated in FIG. 1, and in part in FIGS. 2, 4, 5, and 6, a conventional roller tube 54, via its respective roller tube end subassemblies 52, inclusive of shafts 50, is rotatably supported between the tops of the upright supports 24, where the ends of the rafter bars 30, are likewise rotatably supported. Their conventional roller tube end subassemblies 52, include a retaining split ring 80, a lever operated locking subassembly 82, bearings 84, a cylindrical housing 86, a shaft 50, a return force coiled spring 88 surrounding the shaft 50, to which one end of the spring 88 is secured, and a spring load transfer gear 90 inserted in the roller tube and around the shaft 50 to receive the other end of the coiled spring 88. The spring load transfer gear 90 about its periphery has recessed structures, not shown, which surround the restrictive entry slide in longitudinal receiving structures 92. These conventional restrictive entry slide in longitudinal receiving structures 92, also called awning end receivers 92, are like the circular grooves having their respective restricted slots communicating with the circular grooves of the rollers shown, for example, in the prior U.S. Pat. Nos. 3,612,145 of 1971 and 4,258,778. They are integrally formed in the roller tube 54 at three spaced radial locations, to selectively receive the longitudinal end of the awning 28, inclusive of its wrapped lengthwise cord, not shown, but as shown in FIG. 2 of U.S. Pat. No. 3,612,145 of 1971. When the awning 28 is pulled out to one or more of its selective positions, the coiled spring 88 is thereby loaded creating a return force, which remains until the lever operated locking subassembly 82 is released, when the awning is retracted.

The Interior, Partial Length, Centered Stiffener for Insertion Into the Awning Roller Tube As illustrated in FIG. 1, a retractable awning assembly 20 is often installed alongside a motor home 22 over a long span. As a consequence, the conventional roller tube 54 does sag and this sagging is reflected in the awning 28. Therefore, to substantially eliminate such sagging on long span retractable awning assemblies 20, now already installed on many mobile dwellings and elsewhere, and those to be installed in the future, as shown in FIGS. 2, 4, 5, and 6, an interior, partial length, centered stiffener 94 is inserted into the respective roller tubes 54.

One embodiment is shown in FIGS. 2 and 5, and another embodiment is shown in FIG. 6, and both embodiments of this interior, partial length, centered stiffener 94 are positioned as illustrated in FIG. 4. In FIGS. 2 and 5, this stiffener 94 is essentially cylindrical in cross section having an outside diameter, which is enough smaller than the inside diameter of the roller tube 54, so no binding will occur during its endwise installation into the roller tube 54. Also at three complementing radial locations there are wide recessed structures 96, or lengthwise grooves, integrally formed in this stiffener 94 to provide oversize clearances in accommodating the awning end receivers 92, also called the restrictive entry slide in long receiving structures 92, on the roller tube 54 used in securing the prepared end of the awning 28 to the roller tube 54. The formation of these wide recessed structures, during extrusion, in addition to providing clearances, also tends to improve the bending resistance capabilities of this stiffener 94.

The lengths of respective interior, partial length, centered stiffeners, will always be short enough to provide clearance for the coiled springs 88 and their related components. The stiffeners will always, otherwise, be long enough, to substantially eliminate any appreciable sagging of the long span roller tube 54. By way of example, in a sixteen foot long roller tube 54, a ten foot long stiffener 94 has been installed, and in a twenty one foot long roller tube 54, a fourteen foot long stiffener 94 has been installed. Their centered position is maintained by using fasteners, not shown, which interconnect the roller tube 54 and a stiffener 94 along a common radius without interfering with the roll up of the awning 28. During such initial securement of this stiffener 94 to the roller tube 54, the roller tube 54 optionally is prestressed in respect to bending, creating an overall advantageous prestressing, in respect to resisting bending, in the completed assembly of the roller tube 54 and its interior, partial length centered stiffener 94.

In FIG. 6, another embodiment is illustrated of an interior, partial length centered stiffener 98. It has an offset X cross section having at one radial location an internal receiving channel 100, which, upon the endwise insertion of this stiffener 98, is positioned about one of the restrictive entry slide in long receiving structures 92 on the interior of the roller tube 54. At the three remaining radial locations respective integral foot supports 102 are formed to alternately contact, as necessary, the interior of the roller tube 54. The overall diameter of this stiffener embodiment 98 is always less than the interior diameter of the roller tube 54, so the endwise insertion of this stiffener 98 never results in any binding within the roller tube 54.

When either stiffener 94 or 98, or an interior, partial length, centered, stiffener of similar specifications is installed within a roller tube, any possible noticeable sagging then or thereafter is eliminated, and the supported awnings, without the reflection of any sag, appear neat and trim and do not tend to collect rain water and/or debris.

I claim:

1. An improved rafter bar for a retractable awning comprising:

a U-shaped channel having upstanding sides and outer and inner ends, said outer end pivotally mounted to the awning;

a box channel pivotally connected to said inner end of said U-shaped channel at a pivot position to move between extended and retracted orientations;

said upstanding sides having inwardly tapering opposed sidewall portions at said inner end;

a dual button latching mechanism mounted within said box channel, said latching mechanism including a common spring to which a locking button and a releasing button are mounted at spaced apart positions, said buttons passing through opening means in said box channel;

said buttons positioned so when said U-shaped channel and box channel are in said extended orientation said locking button engages a complementary locking opening in said U-shaped channel and said releasing button is free of overlying material so said releasing button is accessible by a user, said locking and releasing buttons both being observable when said channels are in said extended orientation, whereby depressing said releasing button deflects said common spring to disengage said locking button from said locking opening to allow said U-shaped channel to be pivoted from said extended orientation toward said retracted orientation; and one of said tapering sidewall portions being opposed to said locking button to act as a camming surface for said locking button as said U-shaped channel moves to said extended position.

2. An improved rafter bar for a retractable awning comprising:

a U-shaped channel having upstanding sides and outer and inner ends, said outer end pivotally mounted to the awning;

a box channel pivotally connected to said inner end of said U-shaped channel at a pivot position to move between extended and retracted relative orientations;

a dual button latching mechanism mounted to said box channel, said latching mechanism including a common spring to which a locking button and a releasing button are mounted at spaced apart positions, said buttons being at least partially external of said box channel; and said buttons positioned so when said U-shaped channel and said box channel are in said extended relative orientation, said locking button engages a complementary locking recess in said U-shaped channel and said releasing button is free of overlying material so said releasing button is accessible by a user, whereby depressing said releasing button deflects said common spring to disengage said locking button from said locking recess to allow said U-shaped channel to be pivoted from said extended relative orientation toward said retracted relative orientation.

* * * * *